US006065163A

United States Patent [19]

Hung

[11] Patent Number: 6,065,163

[45] Date of Patent: May 23, 2000

[54] FOLDABLE BED FRAME ASSEMBLY

[76] Inventor: James Hung, 58, Ma Yuan West St., Taichung, Taiwan

[21] Appl. No.: 09/210,352

[22] Filed: Dec. 11, 1998

[51] Int. Cl.[7] ..... A47D 13/06

[52] U.S. Cl. ..... 5/99.1; 5/98.1

[58] Field of Search ..... 5/98.1, 98.3, 99.1

[56] References Cited

U.S. PATENT DOCUMENTS 5,279,006 1/1994 Teng ..... 5/98.1 X
5,353,451 10/1994 Hsiung ..... 5/98.1 X
5,497,517 3/1996 Wang ..... 5/99.1
5,781,944 7/1998 Huang ..... 5/99.1
5,970,540 10/1999 Cheng ..... 5/99.1

*Primary Examiner*—Michael F. Trettel

[57] ABSTRACT

A foldable bed frame assembly has an upper frame device, a bottom frame device, and four perpendicular rods connected to the upper frame device and the bottom frame device. The bottom frame device has four leg seats connected to the perpendicular rods, two V-shaped rods, four reinforced pipes, four pairs of reinforced tubes, two T-shaped tubes, four connection seats, two U-shaped seats, four U-shaped mounts disposed on the V-shaped rods, four additional U-shaped mounts disposed on the reinforced pipes, and four pivot seats. The upper frame device has four corner seats connected to the perpendicular rods, four upper joints, and a plurality of upper rods.

1 Claim, 10 Drawing Sheets

FOLDABLE BED FRAME ASSEMBLY

BACKGROUND OF THE INVENTION

The present invention relates to a foldable bed frame assembly. More particularly, the present invention relates to a foldable bed frame assembly for a baby bed.

A conventional bed frame assembly for a baby bed has a bottom frame device. The bottom frame device is significantly weak. When a child jumps on the baby bed, the bottom frame device may be broken.

SUMMARY OF THE INVENTION

An object of the present invention is to provide a foldable bed frame assembly which can reinforce a baby bed disposed on a bottom frame device of the foldable bed frame assembly.

Accordingly, a foldable bed frame assembly comprises an upper frame device, a bottom frame device, and four perpendicular rods connected to the upper frame device and the bottom frame device. The bottom frame device has four leg seats connected to the perpendicular rods, two V-shaped rods, four reinforced pipes, four pairs of reinforced tubes, two T-shaped tubes, four connection seats, two U-shaped seats, four U-shaped mounts disposed on the V-shaped rods, four additional U-shaped mounts disposed on the reinforced pipes, and four pivot seats. Each T-shaped tube is disposed on a middle portion of the respective V-shaped rod. Two ends of each V-shaped rod are connected to the respective leg seats. The connection seats are disposed on the respective V-shaped rod. Two ends of each reinforced pipe are inserted in the respective connection seat and the respective U-shaped seat. Two ends of each reinforced tube are inserted in the respective U-shaped mount and the respective pivot seat. The upper frame device has four corner seats connected to the perpendicular rods, four upper joints, and a plurality of upper rods. Two ends of each upper rod are inserted in the respective corner seat and the respective upper joint. Each upper rod has a round hole and a round aperture. Each upper joint has a main body, an operation bar disposed on the main body, two circular holes formed on the main body, four circular apertures formed on the main body, two notches formed on the main body, a plurality of through apertures formed on the main body, and two elastic plates. Each elastic plate has a protruded block. Each elastic plate is inserted in the respective upper rod. Each protruded block is inserted in the respective round hole. The operation bar has two distal holes, and two protrosions inserted in the circular holes. Each protrosion contacts the respective protruded block. Two fastener rods pass through the through apertures and the round apertures. Two pivot rods pass through the distal holes and the circular apertures.

DETAILED DESCRIPTION OF THE INVENTION

Figure 1:
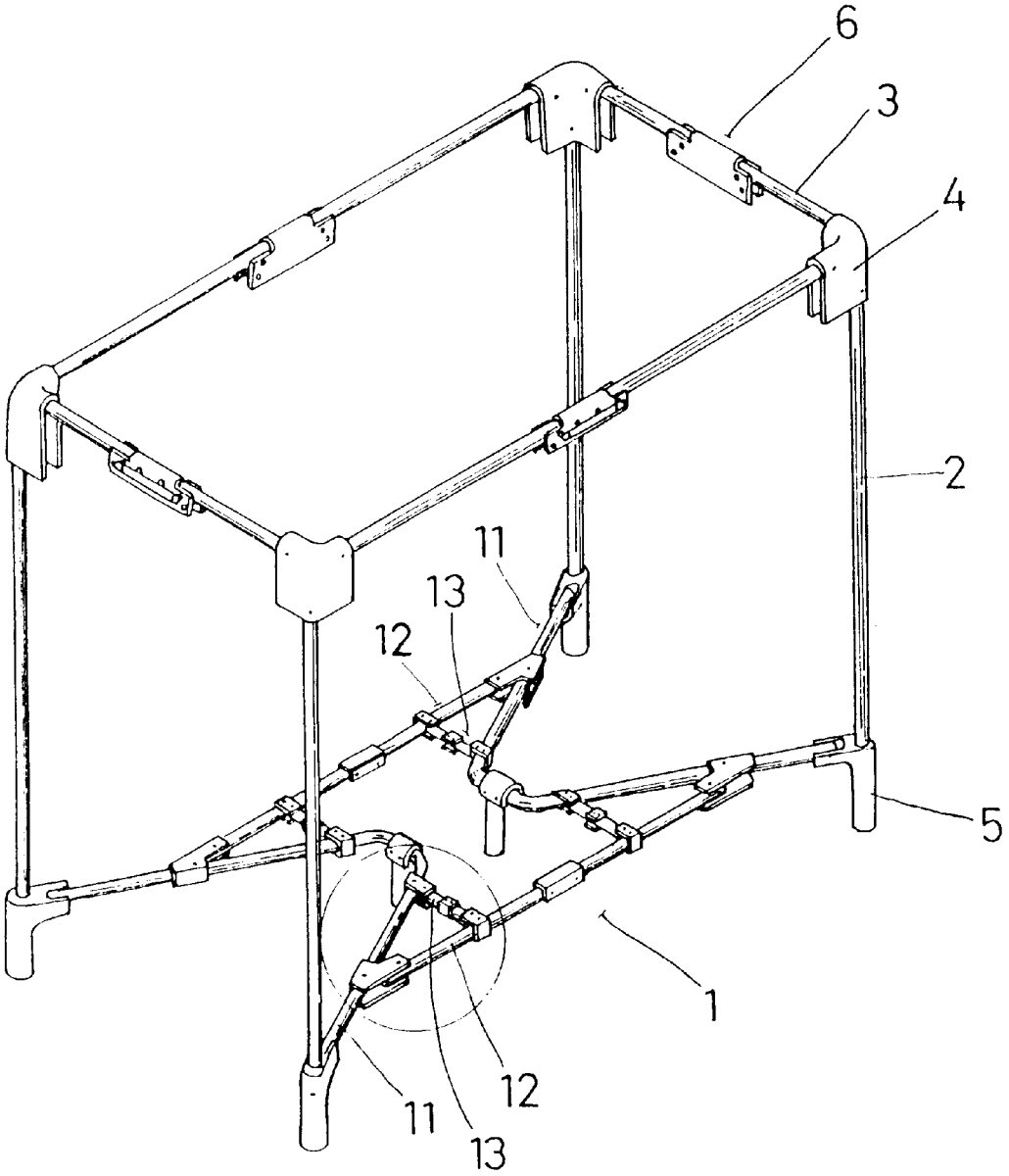
FIG. 1 is a perspective view of a foldable bed frame assembly of a preferred embodiment in accordance with the present invention.
Figure 2:
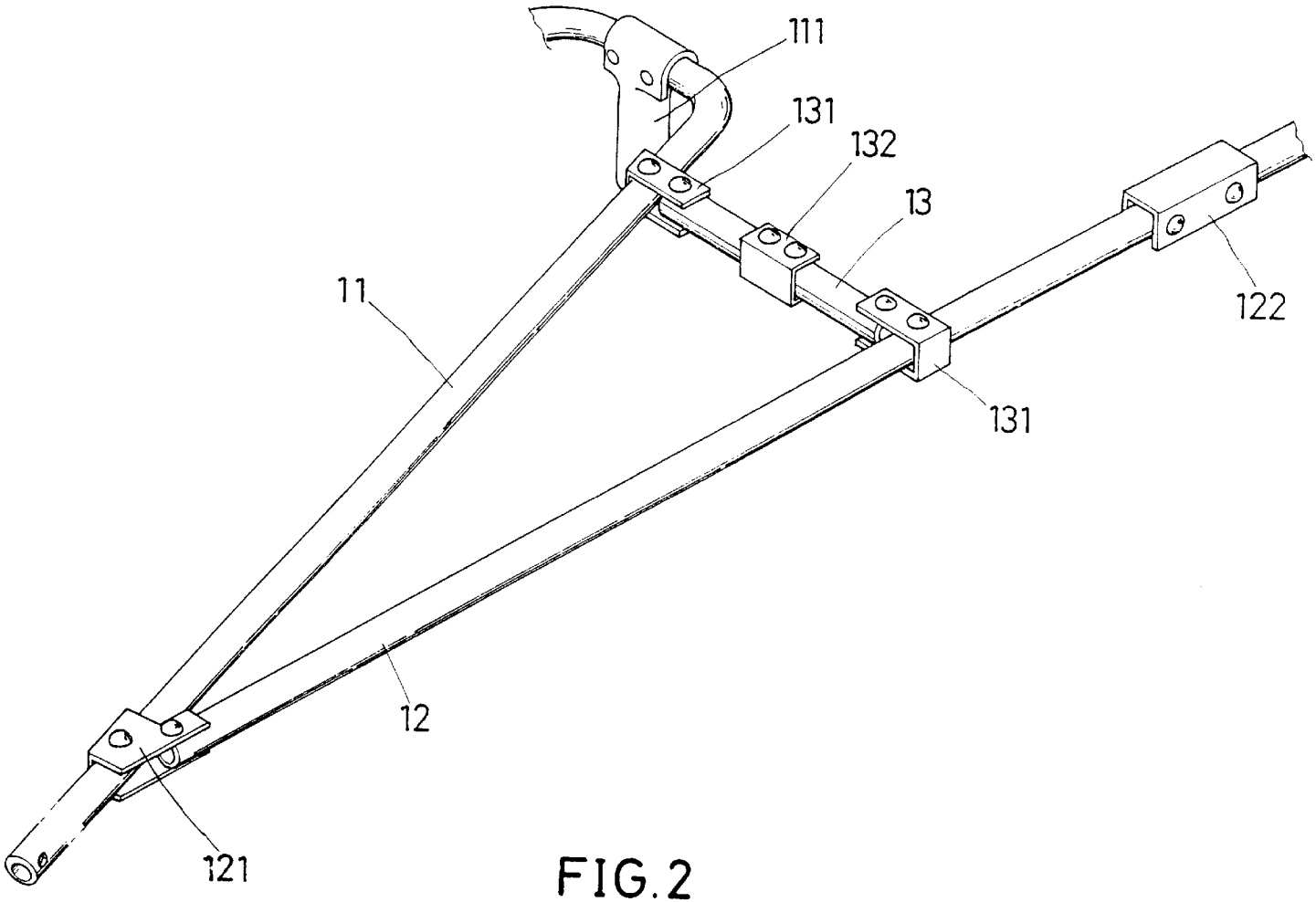
FIG. 2 is a partially perspective view of a bottom frame device of a preferred embodiment in accordance with the present invention.
Figure 3:
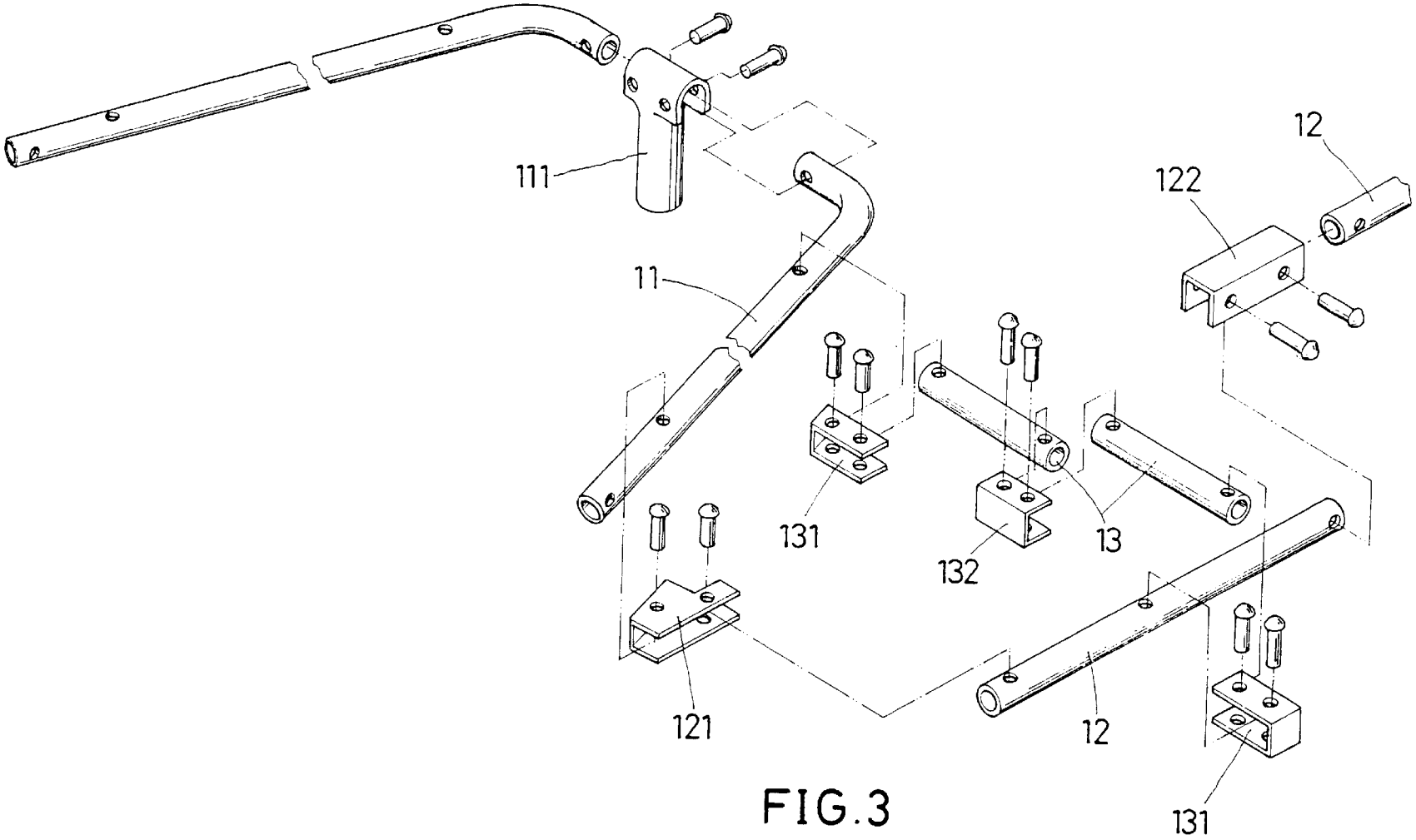
FIG. 3 is a partially perspective exploded view of a bottom frame device of a preferred embodiment in accordance with the present invention.
Figure 4:
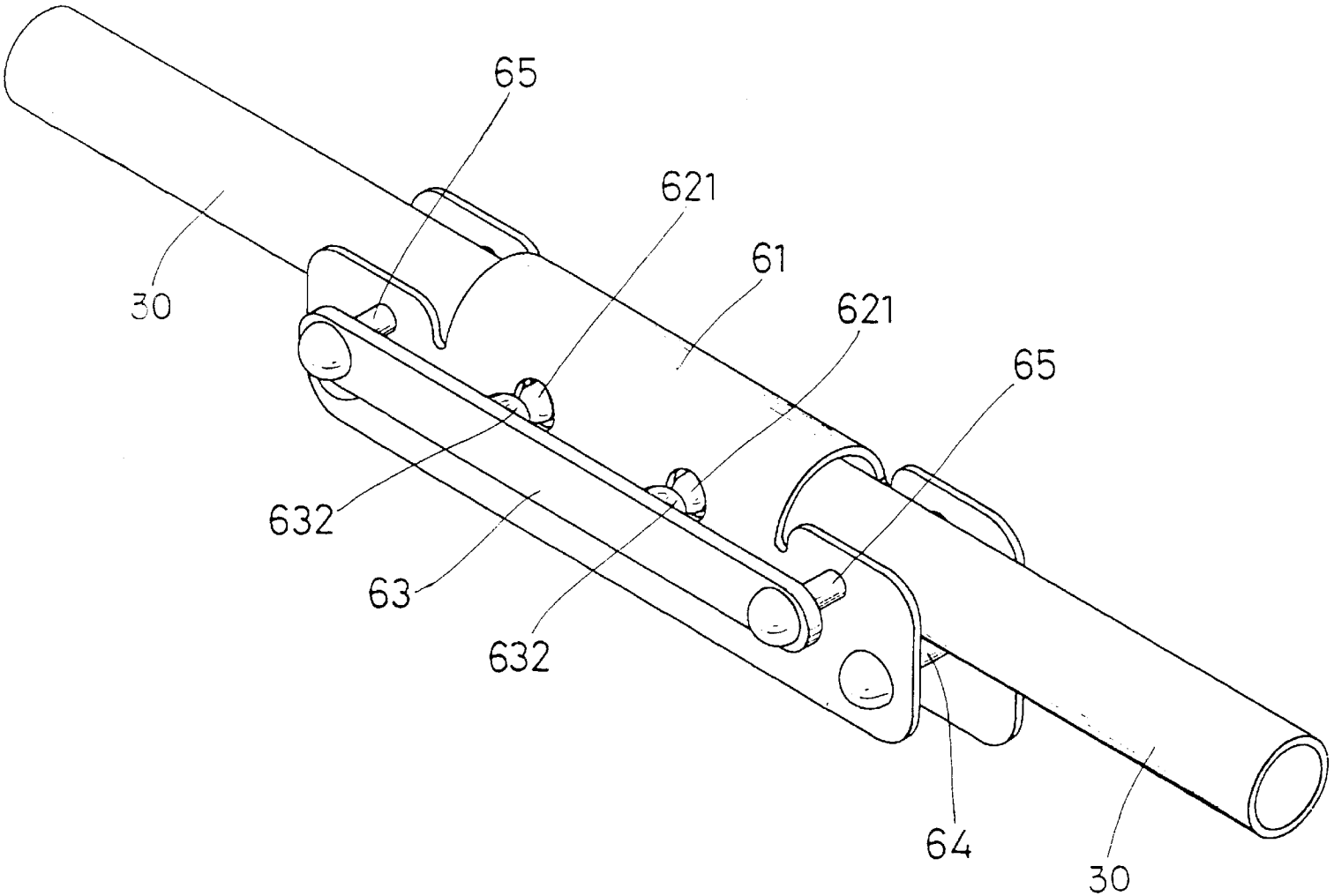
FIG. 4 is a perspective assembly view of an upper joint and two upper rods of a preferred embodiment in accordance with the present invention.

Referring to FIGS. 1 to 6, a foldable bed frame assembly comprises an upper frame device 3, a bottom frame device 1, and four perpendicular rods 2 connected to the upper frame device 3 and the bottom frame device 1.

The bottom frame device 1 has four leg seats 5 connected to the perpendicular rods 2, two V-shaped rods 11, four reinforced pipes 12, four pairs of reinforced tubes 13, two T-shaped tubes 111, four connection seats 121, two U-shaped seats 122, four U-shaped mounts 131 disposed on the V-shaped rods 11, four additional U-shaped mounts 131 disposed on the reinforced pipes 12, and four pivot seats 132.

Each T-shaped tube 111 is disposed on a middle portion of the respective V-shaped rod 11.

Two ends of each V-shaped rod 11 are connected to the respective leg seats 5.

The connection seats 121 are disposed on the 121 respective V-shaped rod 11.

Two ends of each reinforced pipe 12 are inserted in the respective connection seat 121 and the respective U-shaped seat 122.

Two ends of each reinforced tube 13 are inserted in the respective U-shaped mount 131 and the respective pivot seat 132.

The upper frame device 3 has four corner seats 4 connected to the perpendicular rods 2, four upper joints 6, and a plurality of upper rods 30.

Two ends of each upper rod 30 are inserted in the respective corner seat 4 and the respective upper joint 6.

Each upper rod 30 has a round hole 31 and a round aperture 32.

Each upper joint 6 has a main body 61, an operation bar 63 disposed on the main body 61, two circular holes 611 formed on the main body 61, four circular apertures 612 formed on the main body 61, two notches 610 formed on the main body 61, a plurality of through apertures 613 formed on the main body 61, and two elastic plates 62.

Each elastic plate 62 has a protruded block 621. Each elastic plate 62 is inserted in the respective upper rod 30. Each protruded block 621 is inserted in the respective round hole 31.

The operation bar 63 has two distal holes 631, and two protrosions 632 inserted in the circular holes 611. Each protrosion 632 contacts the respective protruded block 621.

Two fastener rods 65 pass through the through apertures 613 and the round apertures 32.

Two pivot rods 64 pass through the distal holes 631 and the circular apertures 612.

Figure 5:
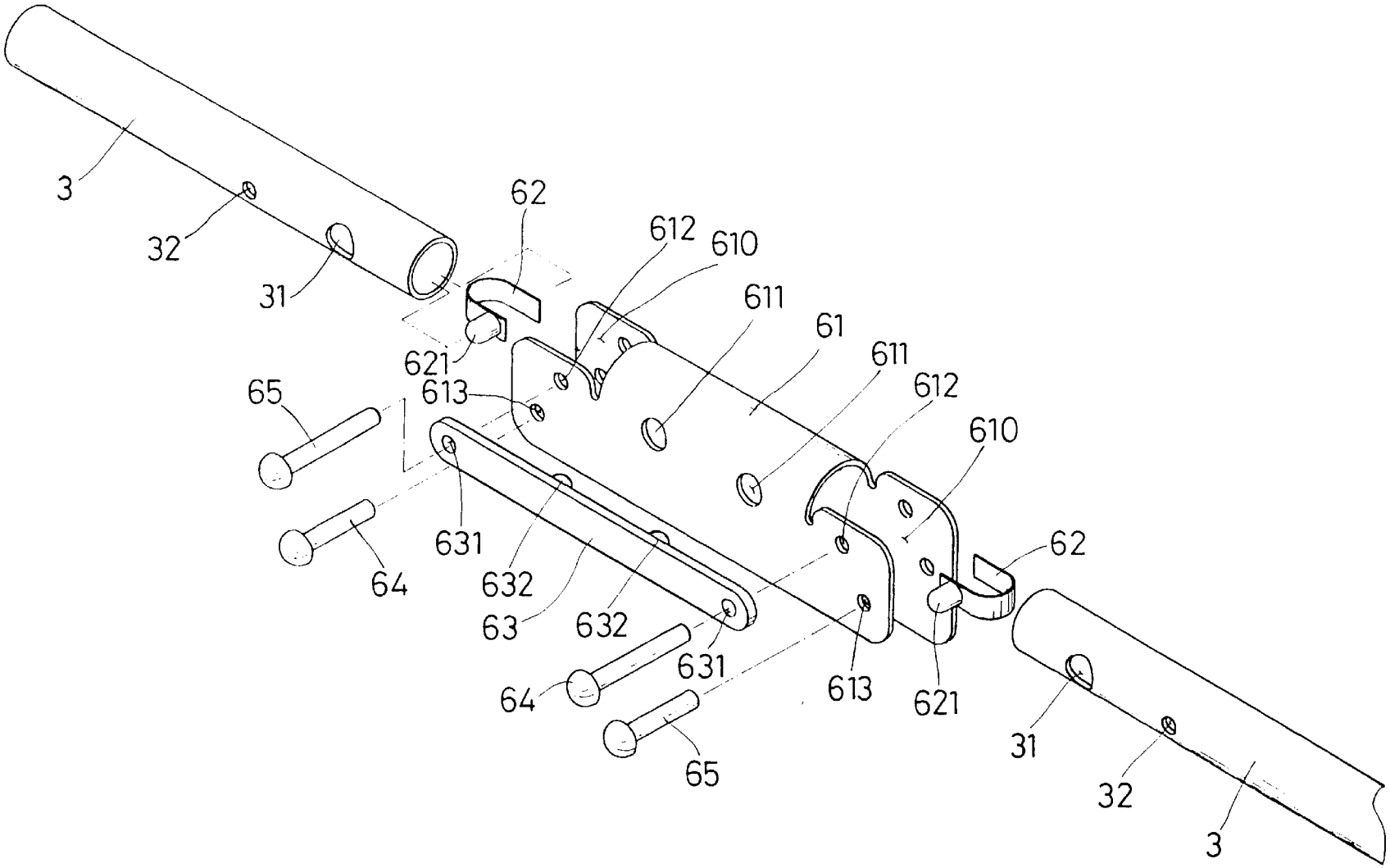
FIG. 5 is a perspective exploded view of an upper joint and two upper rods of a preferred embodiment in accordance with the present invention.
Figure 6:
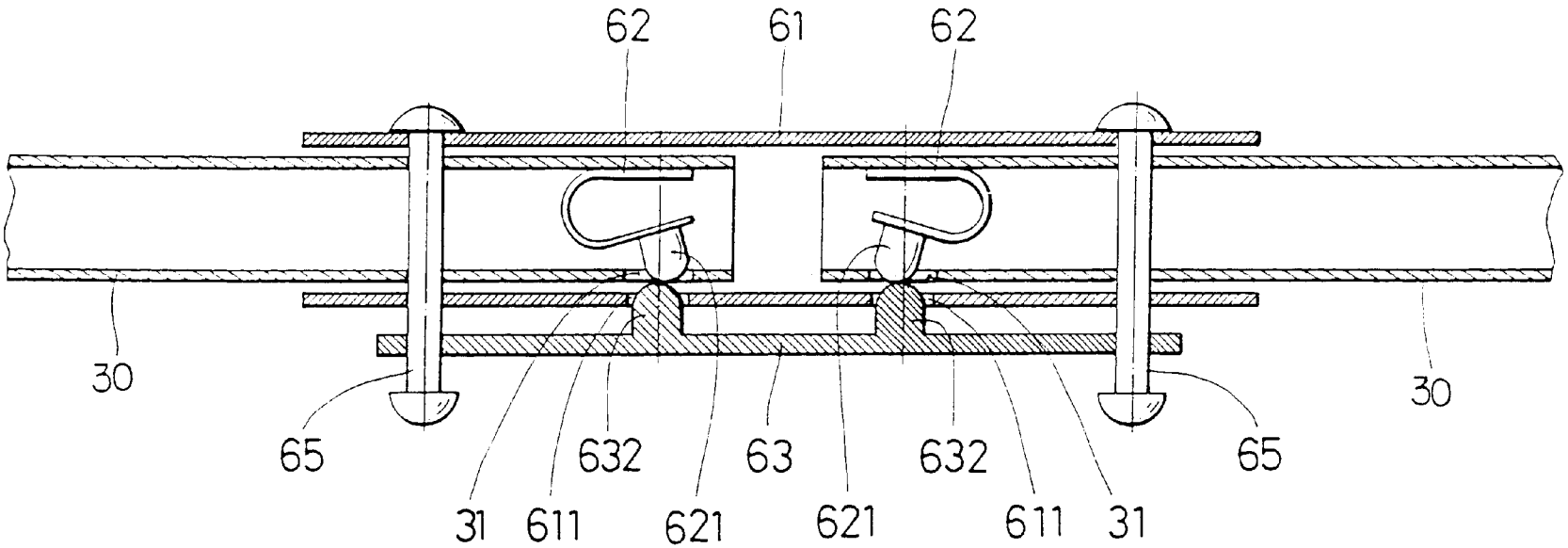
FIG. 6 is a sectional assembly view of FIG. 4.
Figure 8:
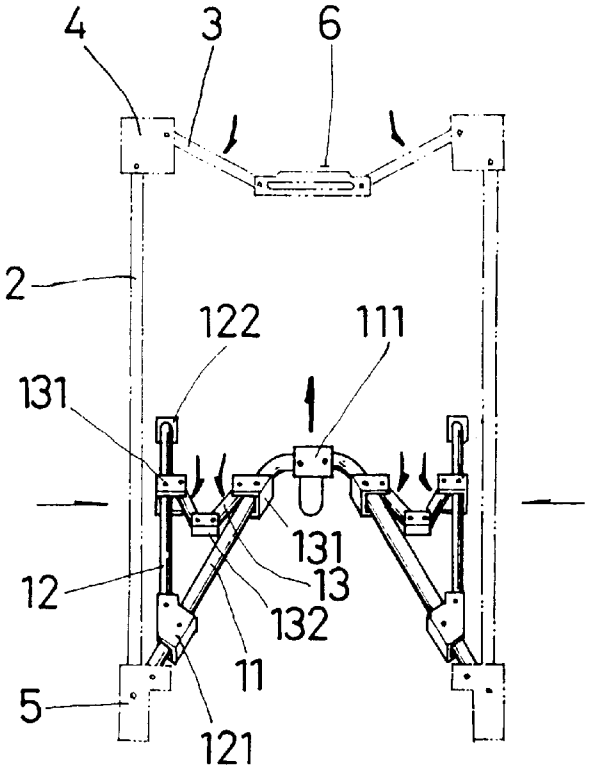
FIG. 8 is a schematic view illustrating another operation of a foldable bed frame assembly of a preferred embodiment in accordance with the present invention.
Figure 7:
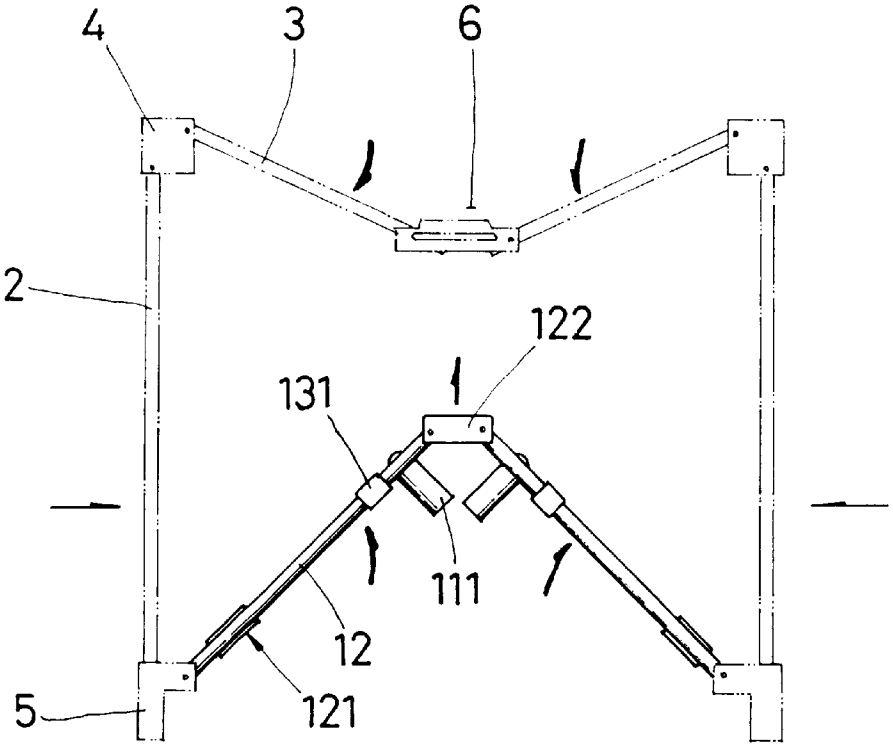
FIG. 7 is a schematic view illustrating an operation of a foldable bed frame assembly of a preferred embodiment in accordance with the present invention.

Referring to FIGS. 5, 7 and 8, the operation bar 63 is pressed toward the elastic plates 62. The protruded blocks 621 are disengaged from the round holes 31. The upper rods 30 are bent downward. The T-shaped tubes 111 are moved upward. The U-shaped seats 122 are moved upward. Then the foldable bed frame assembly is folded.

Figure 9:
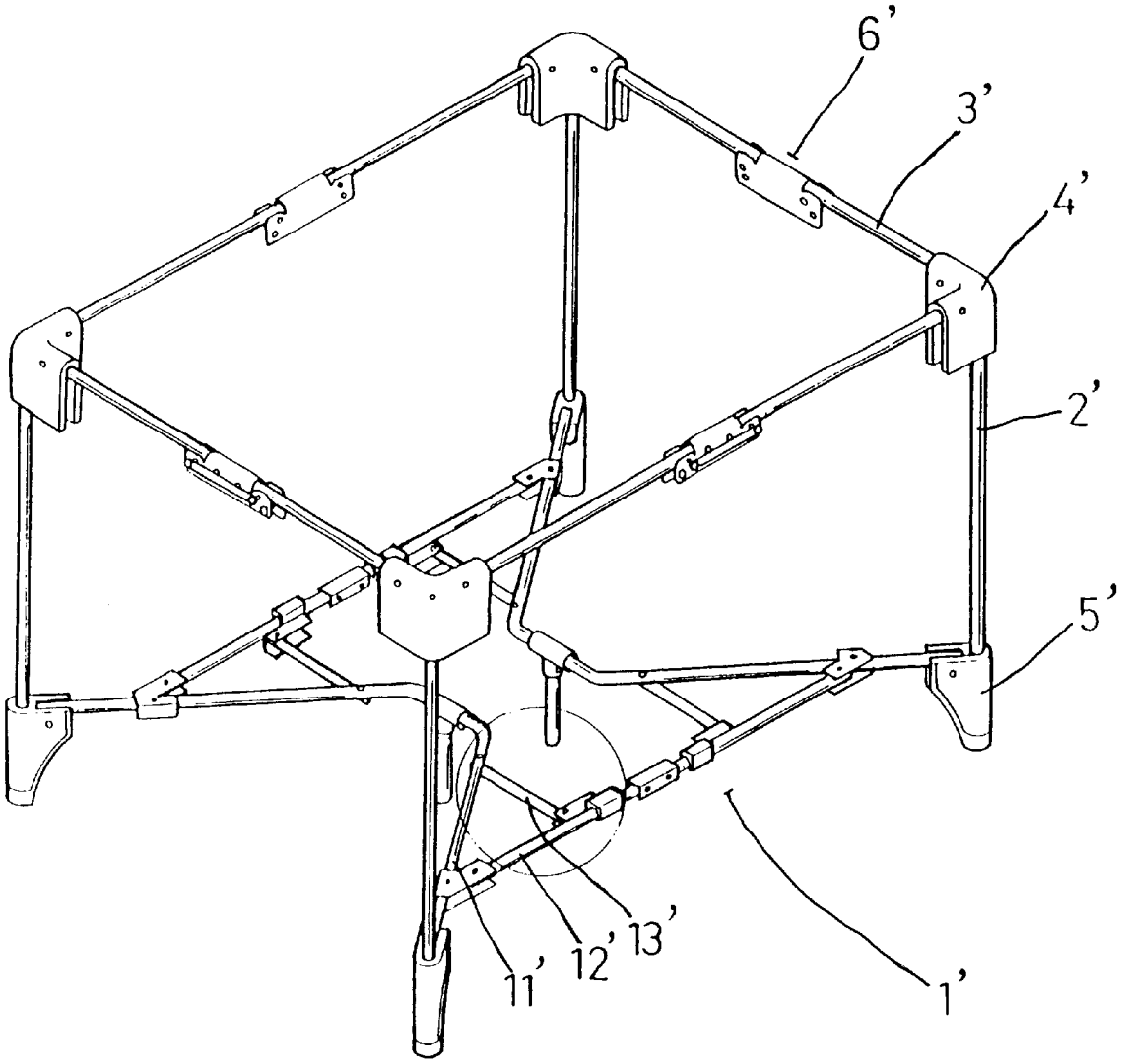
FIG. 9 is a perspective view of a foldable bed frame assembly of another preferred embodiment in accordance with the present invention.
Figure 10:
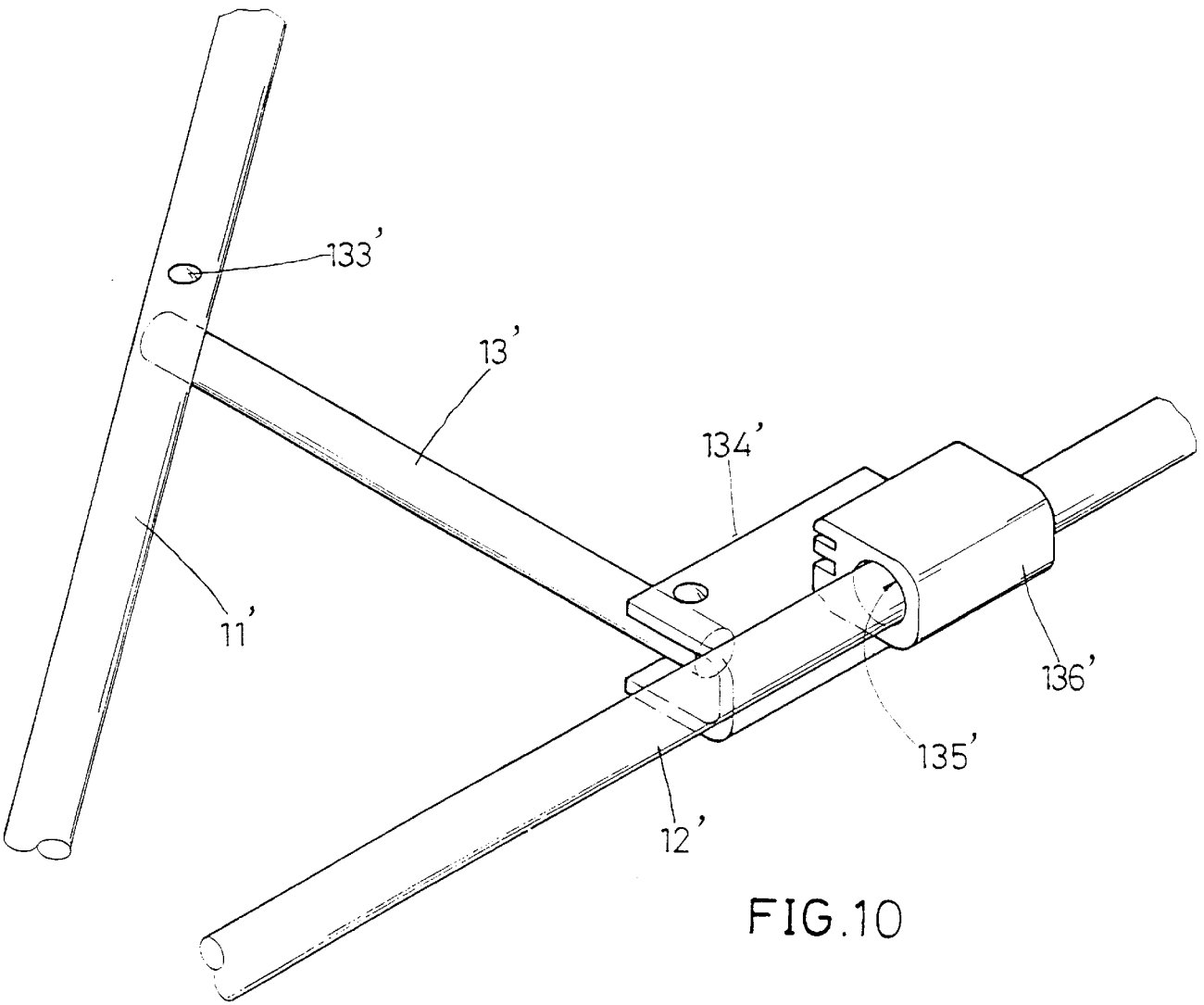
FIG. 10 is a partially perspective view of a bottom frame device of another preferred embodiment in accordance with the present invention.
Figure 11:
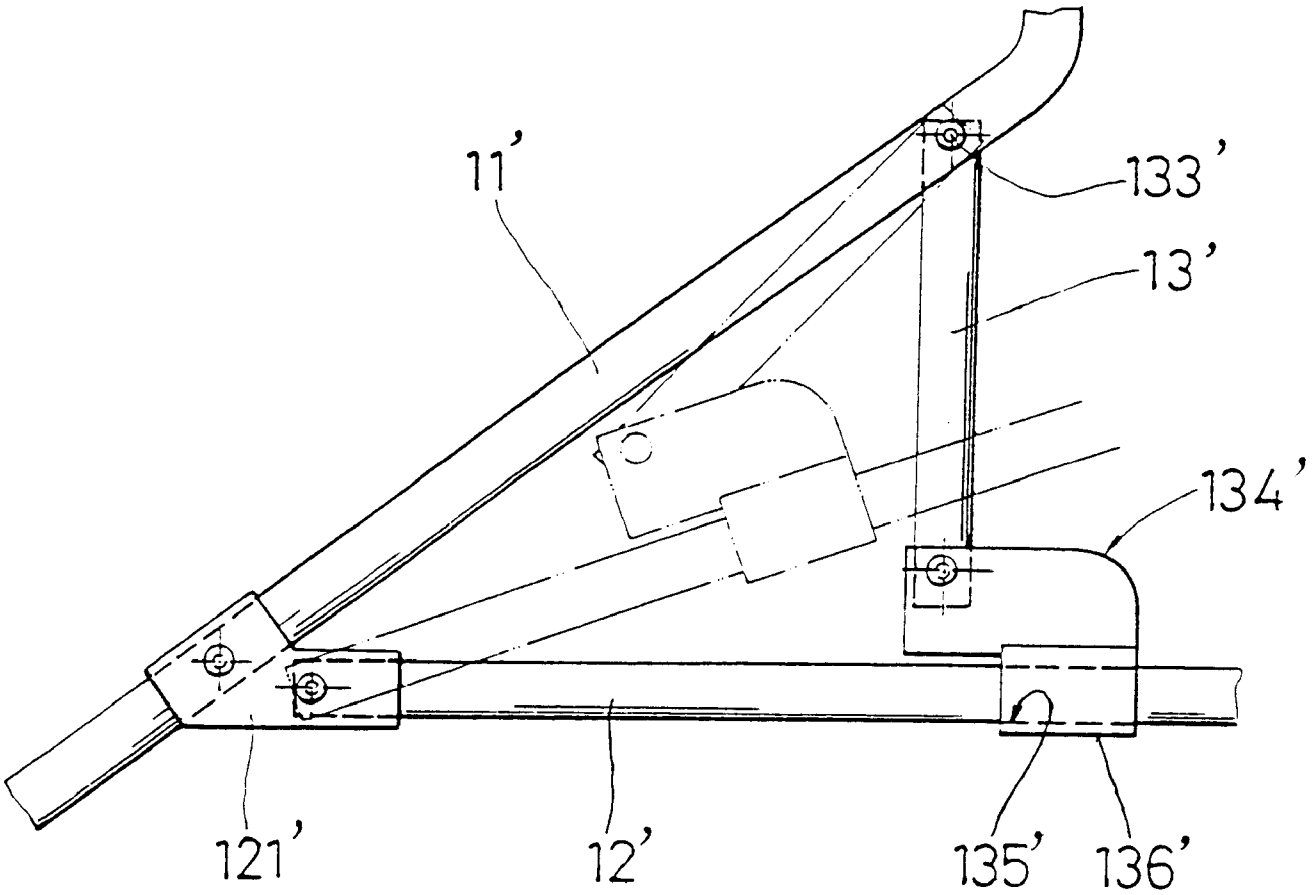
FIG. 11 is another partially perspective view of a bottom frame device of another preferred embodiment in accordance with the present invention.

Referring to FIGS. 9 to 11, another foldable bed frame assembly comprises an upper frame device 3', a bottom frame device 1', and four perpendicular rods 2' connected to the upper frame device 3' and the bottom frame device 1'.

The bottom frame device 1' has four leg seats 5' connected to the perpendicular rods 2', two V-shaped rods 11', four reinforced pipes 12', two pairs of reinforced tubes 13', four sleeves 136', and four slide blocks 134'.

Each V-shaped rod 11' has a pivot fastener 133'. Each sleeves 136' has a through hole 135' receiving the respective reinforced pipe 12'. Each slide blocks 134' is connected to the respective sleeve 136'. An end of each reinforced tube 13' is inserted in the respective slide block 134'.

The upper frame device 3' has four corner seats 4' connected to the perpendicular rods 2', four upper joints 6', and a plurality of upper rods. Two ends of each upper rod are inserted in the respective corner seat 4' and the respective upper joint 6'.

The invention is not limited to the above embodiment but various modification thereof may be made. Further, various changes in form and detail may be made without departing from the scope of the invention.

I claim:

1. A foldable bed frame assembly comprising:

an upper frame device, a bottom frame device, and four perpendicular rods connected to the upper frame device and the bottom frame device, the bottom frame device having four leg seats connected to the perpendicular rods, two V-shaped rods, four reinforced pipes, four pairs of reinforced tubes, two T-shaped tubes, four connection seats, two U-shaped seats, four U-shaped mounts disposed on the V-shaped rods, four additional U-shaped mounts disposed on the reinforced pipes, and four pivot seats, each said T-shaped tube disposed on a middle portion of the respective V-shaped rod, two ends of each said V-shaped rod connected to the respective leg seats, the connection seats disposed on the respective V-shaped rod, two ends of each said reinforced pipe inserted in the respective connection seat and the respective U-shaped seat, two ends of each said reinforced tube inserted in the respective U-shaped mount and the respective pivot seat, the upper frame device having four corner seats connected to the perpendicular rods, four upper joints, and a plurality of upper rods, two ends of each said upper rod inserted in the respective corner seat and the respective upper joint, each said upper rod having a round hole and a round aperture, each said upper joint having a main body, an operation bar disposed on the main body, two circular holes formed on the main body, four circular apertures formed on the main body, two notches formed on the main body, a plurality of through apertures formed on the main body, and two elastic plates, each said elastic plate having a protruded block, each said elastic plate inserted in the respective upper rod, each said protruded block inserted in the respective round hole, the operation bar having two distal holes, and two protrosions inserted in the circular holes, two fastener rods passing through the through apertures and the round apertures, and two pivot rods passing through the distal holes and the circular apertures.

* * * * *